US008992004B2

(12) United States Patent
Leighton et al.

(10) Patent No.: US 8,992,004 B2
(45) Date of Patent: Mar. 31, 2015

(54) FLOW OPTIMIZATION FOR COMPACT TURNBAR REVERSERS

(71) Applicant: Xerox Corporation, Norwalk, CT (US)

(72) Inventors: Roger G. Leighton, Hilton, NY (US); Kevin Cole, Ontario, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/941,766

(22) Filed: Jul. 15, 2013

(65) Prior Publication Data

US 2015/0015652 A1 Jan. 15, 2015

(51) Int. Cl.

| | |
|---|---|
| ***B41J 2/01*** | (2006.01) |
| ***B41J 11/00*** | (2006.01) |
| ***B65H 23/32*** | (2006.01) |

(52) U.S. Cl.

CPC ..... *B41J 11/0045* (2013.01); *B65H 23/32* (2013.01)

USPC ..... 347/104; 101/232; 65/97.3; 242/615.12

(58) Field of Classification Search

CPC ..... B41J 3/60; B41J 15/00; B65H 23/32

See application file for complete search history.

(56) References Cited

U.S. PATENT DOCUMENTS

| | | | | |
|---|---|---|---|---|
| 5,273,201 | A * | 12/1993 | Hambrecht | 242/615.12 |
| 5,996,491 | A | 12/1999 | Kishine et al. | |
| 6,418,851 | B1 | 7/2002 | Hartmann et al. | |
| 6,533,217 | B2 * | 3/2003 | Lind | 242/615.12 |
| 6,595,465 | B2 | 7/2003 | Lamothe | |
| 2010/0059567 | A1 | 3/2010 | Opfer et al. | |
| 2013/0152807 | A1 * | 6/2013 | Armbruster et al. | 101/232 |

* cited by examiner

*Primary Examiner* — Shelby Fidler
*Assistant Examiner* — Tracey McMillion
(74) *Attorney, Agent, or Firm* — Maginot Moore & Beck LLP

(57) ABSTRACT

A system and method for printing on a continuous web of imaging material in an inkjet printing machine having a turnbar reverser to reverse the direction of the web for duplex printing. The turnbar reverser includes at least one turnbar having a predetermined pattern of apertures formed in a surface of the turnbar. The optimized apertures direct a flow of air provided by a blower to provide an air flow to float the web above the surface of the turnbar, allow for higher operating tensions, and reduce acoustic noise generation.

13 Claims, 7 Drawing Sheets

FLOW OPTIMIZATION FOR COMPACT TURNBAR REVERSERS

TECHNICAL FIELD

This disclosure relates generally to a printing system and methods for transporting a continuous web of recording media for duplex printing in the printing system. The disclosure includes a turnbar reverser to enable duplex printing on both sides of the continuous web of imaging material.

BACKGROUND

In general, inkjet printing machines or printers include at least one printhead unit that ejects drops of liquid ink onto recording media or an imaging member for later transfer to media. Different types of ink can be used in inkjet printers. In one type of inkjet printer, phase change inks are used. Phase change inks remain in the solid phase at ambient temperature, but transition to a liquid phase at an elevated temperature. The printhead unit ejects molten ink supplied to the unit onto media or an imaging member. Such printheads can generate temperatures of approximately 110 to 120 degrees Celsius. Once the ejected ink is on media, the ink droplets solidify. The printhead unit ejects ink from a plurality of inkjet nozzles, also known as ejectors.

The media used in both direct and offset (transfix) printers can be in web form. In a web printer, a continuous supply of media, typically provided in a media roller, is entrained onto rollers that are driven by motors. The motors and rollers pull the web from the supply roller through the printer to a take-up roller. The rollers are arranged along a linear media path, and the media web moves through the printer along the media path. As the media web passes through a print zone opposite the printhead or heads of the printer, the printheads eject ink onto the web. Along the feed path, tension bars or other rollers remove slack from the web so the web remains taut without breaking.

Existing web printing systems use a registration control method to control the timing of the ink ejections onto the web as the web passes the printheads. One known registration control method that can be used to operate the printheads is the single reflex method. In the single reflex method, the rotation of a single roller at or near a printhead is monitored by an encoder. The encoder can be a mechanical or electronic device that measures the angular velocity of the roller and generates a signal corresponding to the angular velocity of the roller. The angular velocity signal is processed by a controller executing programmed instructions for implementing the single reflex method to calculate the linear velocity of the web. The controller can adjust the linear web velocity calculation by using tension measurement signals generated by one or more load cells that measure the tension on the web near the roller. The controller implementing the single reflex method is configured with input/output circuitry, memory, programmed instructions, and other electronic components to calculate the linear web velocity and to generate the firing signals for the printheads in the marking stations.

Another existing registration control method that can be used to operate the printheads in a web printing system is the double reflex method. In the double reflex method, each encoder in a pair of encoders monitors one of two different rollers. One roller is positioned on the media path prior to the web reaching the printheads and the other roller is positioned on the media path after the media web passes the printheads. The angular velocity signals generated by the two encoders for the two rollers are processed by a controller executing programmed instructions for implementing the double reflex method to calculate the linear velocity of the web at each roller and then to interpolate the linear velocity of the web at each of the printheads. These additional calculations enable better timing of the firing signals for the printheads in the marking stations and, consequently, improved registration of the images printed by the marking stations in the printing system. Ejection of ink from the inkjet nozzles can be adjusted based on the calculations. A double reflex printing system is disclosed in issued U.S. Pat. No. 7,665,817.

Some continuous feed inkjet printers form printed images on only a first side of the continuous web, a process referred to as a simplex printing operation. Simplex continuous feed inkjet printers have printhead assemblies with printheads that are configured to eject ink across a printing zone on the continuous web that is less than the width of the web. The printing zone is typically centered on the web with appropriate margins on each side of the printing zone. During a simplex printing operation, the continuous web makes only one pass through the printer. Specifically, a rewinder pulls the continuous web through the printer along the web path only once during a simplex printing operation.

Some continuous feed inkjet printers are configured to form printed images on a first and a second side of the continuous web, which is known as a duplex printing operation. In a duplex printing operation, the continuous web makes two passes through the printer, and is referred to as a half-width dual-pass duplex printing operation. In particular, the continuous web is routed from a web supply through the printer to receive ink on the first side. After the continuous web exits the printer, the continuous web is inverted by an inverting system and is then routed again through the printer to receive ink on the second side. One type of duplex continuous feed printer includes an external continuous web inverting system. In another type of duplex continuous feed printer, the web inverting system is incorporated as part of the printer itself. As used herein, the term "inverting", "inverter", or "inversion" refers to manipulation of the web to turn the web from a first side to a second side to enable an unprinted side of the web to be presented to a printhead assembly for printing.

In duplex printing on a continuous web, an image on one side is registered with an image on the other side to insure that portions of an image are not lost when the continuous web is cut into sheets or that an image on a first side is not misaligned with an image on a second side. To insure that proper registration is achieved, the speed of the transport rollers is controlled according to a variety of factors including web and environmental humidity, temperature, atmospheric pressure. For instance if the web either stretches, shrinks, or otherwise becomes distorted during transport through the printer or during imaging, poor quality images can occur. Likewise, the amount of ink deposited on the continuous web can affect the material properties of the web and result in misregistration of images as well. Consequently, improvements to a printing system and to printing images by taking into account the types of media, the amount of ink being deposited on the continuous web, and conditions occurring in the printer are desirable.

SUMMARY

An inversion apparatus configured to invert a continuous web of recording media moving along a path in an imaging system wherein the inversion apparatus includes an input configured to receive the continuous web of recording media, an output, displaced from the input, the output configured to convey the continuous web of recording media after being inverted and a blower configured to provide a flow of forced air. A turnbar is configured to convey the continuous web of recording media between the input and the output and to enable inversion of the continuous web of recording media. The turnbar includes an exterior surface defining a first region having a plurality of apertures operatively connected to the blower and configured to direct the forced air from the exterior surface of the turnbar and a second region through which the forced air is not directed from the exterior surface.

A method of forming a duplex image on a continuous web of recording media having a first side and a second side with the continuous web moving along a transport path through a printer wherein a web inverter includes a turnbar having a surface defining a plurality of apertures, and a blower is operatively connected to the plurality of apertures to provide forced air to the apertures. The method includes imaging the first side of the continuous web of recording media during a first pass through the printer, directing the second side of the continuous web toward the plurality of apertures, directing air through the plurality of apertures to provide an air gap between the second side of the continuous web of recording media and the surface of the turnbar, wherein the directed air is confined to a predetermined region of the surface of the turnbar, the predetermined region extending over a first portion of the surface of the turnbar but not over a second portion of the surface of the turnbar, and imaging the second side of the continuous web of recording media during a second pass through the printer.

In another embodiment, an inversion apparatus is configured to invert a continuous web of recording media moving along a path in an imaging system. The inversion apparatus includes an input configured to receive the continuous web of recording media and an output, displaced from the input, wherein the output is configured to convey the continuous web of recording media after being inverted. A turnbar is configured to convey the continuous web of recording media between the input and the output and to enable inversion of the continuous web of recording media. The turnbar includes an exterior surface defining an air foil region having a plurality of apertures configured to provide an air gap between the surface of the turnbar and the recording media and a second region substantially devoid of apertures.

DETAILED DESCRIPTION

Figure 1:
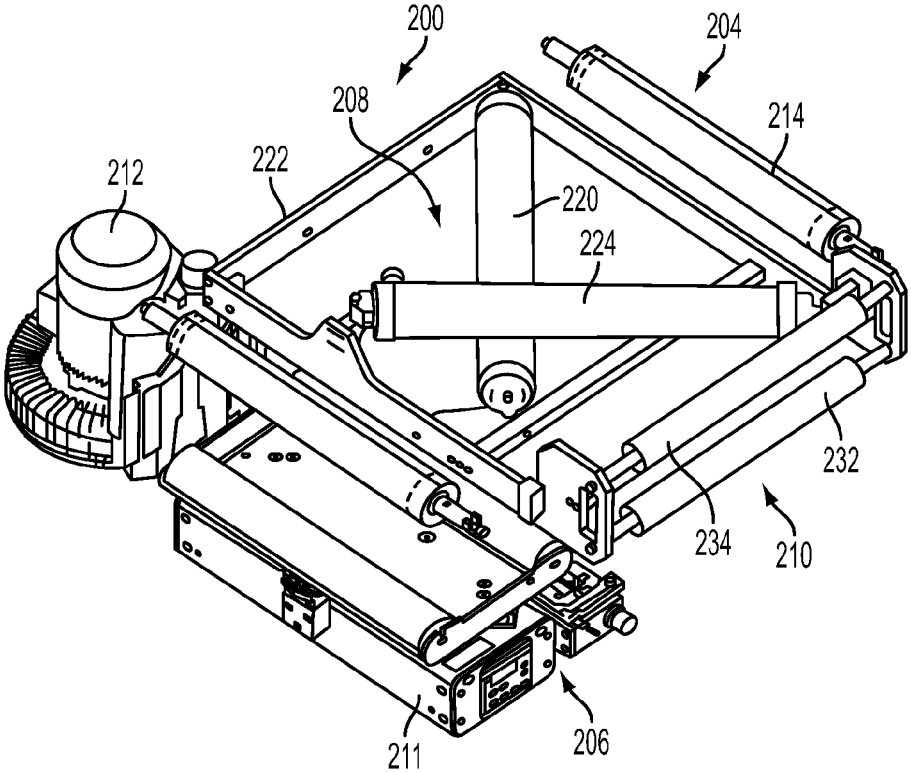
FIG. 1 is perspective view of an inversion apparatus including a blower.

For a general understanding of the environment for the system and method disclosed herein as well as the details for the system and method, the drawings are referenced throughout this document. In the drawings, like reference numerals designate like elements. As used herein the term "printer" or "printing system" refers to any device or system that is configured to eject a marking agent upon an image receiving member and includes photocopiers, facsimile machines, multifunction devices, as well as direct and indirect inkjet printers and any imaging device that is configured to form images on a print medium. As used herein, the term "process direction" refers to a direction of travel of an image receiving member, such as an imaging drum or print medium, and the term "cross-process direction" is a direction that is perpendicular to the process direction along the surface of the image receiving member. As used herein, the terms "web," "media web," and "continuous web of recording media" refer to an elongated print medium that is longer than the length of a media path that the web moves through a printer during the printing process. Examples of media webs include rollers of paper or polymeric materials used in printing. The media web has two sides having surfaces that can each receive images during printing. The printed surface of the media web is made up of a grid-like pattern of potential drop locations, sometimes referred to as pixels.

As used herein, the term "capstan roller" refers to a cylindrical member configured to have continuous contact with the media web moving over a curved portion of the member, and to rotate in accordance with a linear motion of the continuous media web. As used herein, the term "angular velocity" refers to the angular movement of a rotating member for a given time period, sometimes measured in rotations per second or rotations per minute. The term "linear velocity" refers to the velocity of a member, such as a media web, moving in a straight line. When used with reference to a rotating member, the linear velocity represents the tangential velocity at the circumference of the rotating member. The linear velocity v for circular members can be represented as: $v=2\pi r\omega$ where r is the radius of the member and $\omega$ is the rotational or angular velocity of the member.

Figure 9:
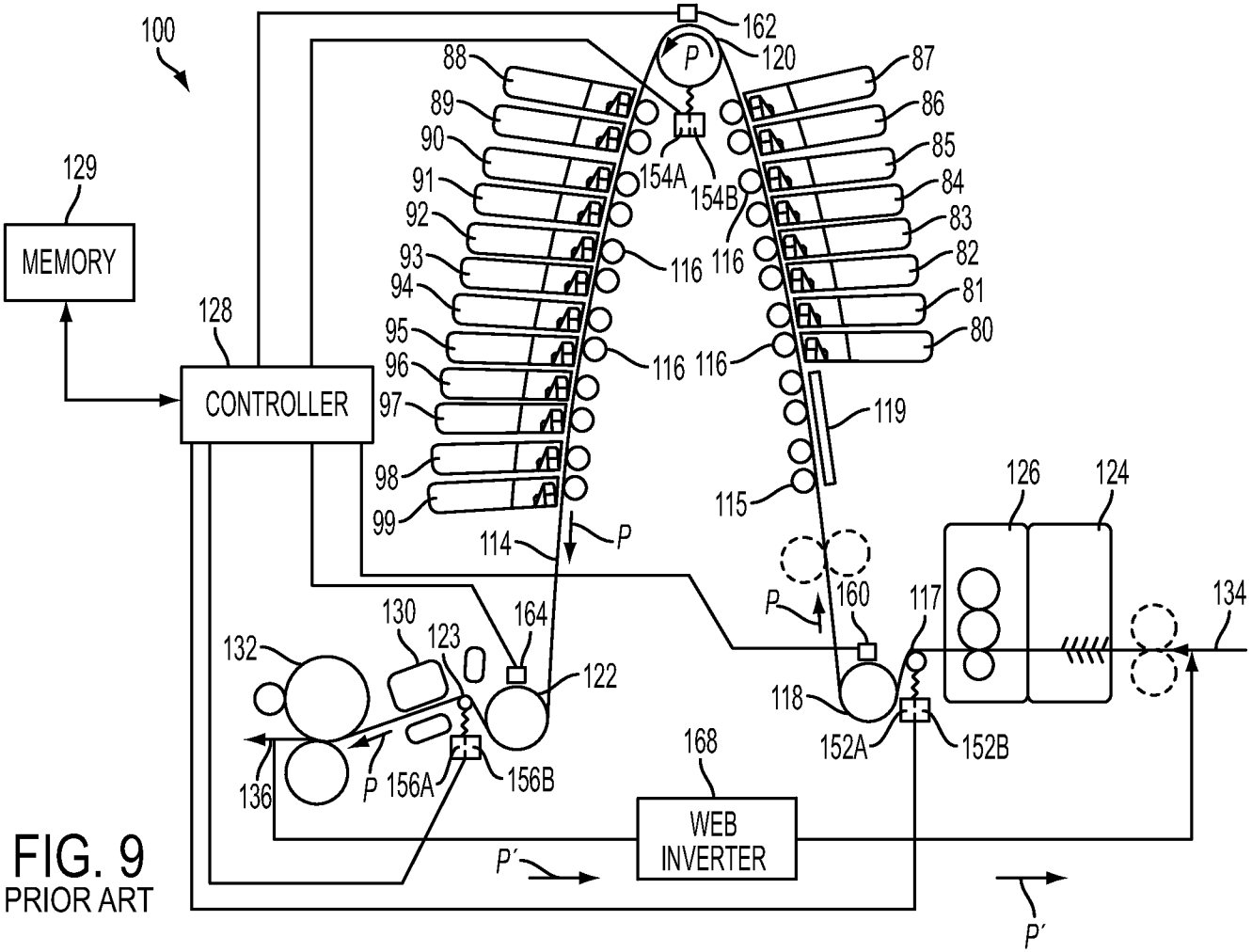
FIG. 9 PRIOR ART
FIG. 9 is a schematic view of a prior art inkjet imaging system that ejects ink onto a continuous web of media as the media moves past the printheads in the system.

FIG. 9 depicts a prior art inkjet printer 100 having elements pertinent to the present disclosure. In the embodiment shown, the printer 100 implements a solid (phase change) ink print process for printing onto a continuous media web. Although a method and system for duplex printing of a continuous web of recording media are described below with reference to the printer 100 depicted in FIG. 9, the subject method and apparatus disclosed herein can be used in any printer, such as a cartridge inkjet printer, which uses serially arranged printheads to eject ink onto a continuous web image substrate.

FIG. 9 depicts a continuous web printer system 100 that includes twenty print modules 80-99, a controller 128, a memory 129, guide roller 115, guide rollers 116, pre-heater roller 118, apex roller 120, leveler roller 122, tension sensors 152A-152B, 154A-154B, and 156A-156B, and velocity sensors, such as encoders 160, 162, and 164. The print modules

80-99 are positioned sequentially along a media path P and form a print zone from a first print module 80 to a last print module 99 for forming images on a print medium 114 as the print medium 114 travels past the print modules. Each print module 80-83 provides a magenta ink. Each print module 84-87 provides cyan ink. Each print module 88-91 provides yellow ink. Each print module 92-95 provides black ink. Each print module 96-99 provides a clear ink as a finish coat. In all other respects, the print modules 80-99 are substantially identical.

The media web travels through the media path P guided by rollers 115 and 116, pre-heater roller 118, apex roller 120, and leveler roller 122. A heated plate 119 is provided along the path adjacent roller 115. In FIG. 9, the apex roller 120 is an "idler" roller, meaning that the roller rotates in response to engaging the moving media web 114, but is otherwise uncoupled from any motors or other drive mechanisms in the printing system 100. The pre-heater roller 118, apex roller 120, and leveler roller 122 are each examples of a capstan roller that engages the media web 114 on a portion of its surface. A brush cleaner 124 and a contact roller 126 are located at one end of the media path P. A heater 130 and a spreader 132 are located at the opposite end 136 of the media path P.

A web inverter 168 is configured to direct the media web 114 from the end 136 of media path P to the beginning 134 of the media path through an inverter path P'. The web inverter 168 flips the media web and the inverter path P' returns the flipped web to the inlet 134 to enable single-engine ("Mobius") duplex printing where the print modules 80-99 form one or more ink images on a second side (second side ink image) of the media web after forming one or more images on the first side (first side ink image). In this operating mode, a first section of the media web moves through the media path P in tandem with a second section of the media web, with the first section receiving ink images on the first side of the media web and the second section receiving ink images on the second side. This configuration can be referred to as a "mobius" configuration. Each of the print modules 80-99 is configured to eject ink drops onto both sections of the media web. Each of the rollers 115, 116, 118, 120, and 122 also engage both the first and second sections of the media web. After the second side of the media web 114 is imaged, the media web 114 passes the end of the media path 136. Registration of a second side ink image to a first side ink image forms a duplex image. In another embodiment, one print module is configured to span the width of the recording media, such that two print modules located side by side are used to eject ink on the first and second sections of the web.

Each of the print modules 80-99 of FIG. 9 includes an array of printheads that are arranged across the width of both the first section of web media and second section of web media. Ink ejectors in each printhead in the array of printheads are configured to eject ink drops onto predetermined locations of both the first and second sections of media web 114.

Operation and control of the various subsystems, components and functions of printing system 100 are performed with the aid of a controller 128 and memory 129. In particular, controller 128 monitors the velocity and tension of the media web 114 and determines timing of ink drop ejection from the print modules 80-99. The controller 128 can be implemented with general or specialized programmable processors that execute programmed instructions. Controller 128 is operatively connected to memory 129 to enable the controller 128 to read instructions and to read and write data required to perform the programmed functions in memory 129. Memory 129 can also hold one or more values that identify tension levels for operating the printing system with at least one type of print medium used for the media web 114. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in VLSI circuits. Also, the circuits described herein can be implemented with a combination of processors, ASICs, discrete components, or VLSI circuits.

Encoders 160, 162, and 164 are operatively connected to preheater roller 118, apex roller 120, and leveler roller 122, respectively. Each of the encoders 160, 162, and 164 are velocity sensors that generate an angular velocity signal corresponding to an angular velocity of a respective one of the rollers 120, 118, and 122. Typical embodiments of encoders 160, 162, and 164 include Hall effect sensors configured to generate signals in response to the movement of magnets operatively connected to the rollers and optical wheel encoders that generate signals in response to a periodic interruption to a light beam as a corresponding roller rotates. Controller 128 is operatively connected to the encoders 160, 162, and 164 to receive the angular velocity signals. Controller 128 can include hardware circuits, software routines, or both, configured to identify a linear velocity of each of the rollers 120, 118, and 122 using the generated signals and a known radius for each roller.

Tension sensors 152A-152B, 154A-154B, and 156A-156B are operatively connected to a guide roller 117, apex roller 120, and post-leveler roller 123, respectively. The guide roller 117 is positioned on the media path P prior to the preheater roller 118. The post-leveler roller 123 is positioned on the media path P after the leveler roller 122. Each tension sensor generates a signal corresponding to the tension force applied to the media web at the position of the corresponding roller. Each tension sensor can be a load cell configured to generate a signal that corresponds to the mechanical tension force between the media web 114 and the corresponding roller.

In FIG. 9 where two sections of the media web 114 engage each roller in tandem, each of the tension sensors are paired to identify the tension on each section of the media web 114. In embodiments where one surface of the media web engages each roller, a single tension sensor can be used instead. Tension sensors 152A-152B generate signals corresponding to the tension on the media web 114 as the media web 114 enters the print zone passing print modules 80-99. The print zone is also known as the ink application zone or the "jetting zone." Tension sensors 154A-154B generate signals corresponding to the tension of the media web around apex roller 120 at an intermediate position in the print zone. Tension sensors 156A-156B generate signals corresponding to the tension of the media web around leveler roller as the media web 114 exits the print zone. The tension sensors 152A-152B, 154A-154B, and 156A-156B are operatively connected to the controller 128 to enable the controller 128 to receive the generated signals and to monitor the tension between apex roller 118 and the media web 114 during operation.

Figure 2:
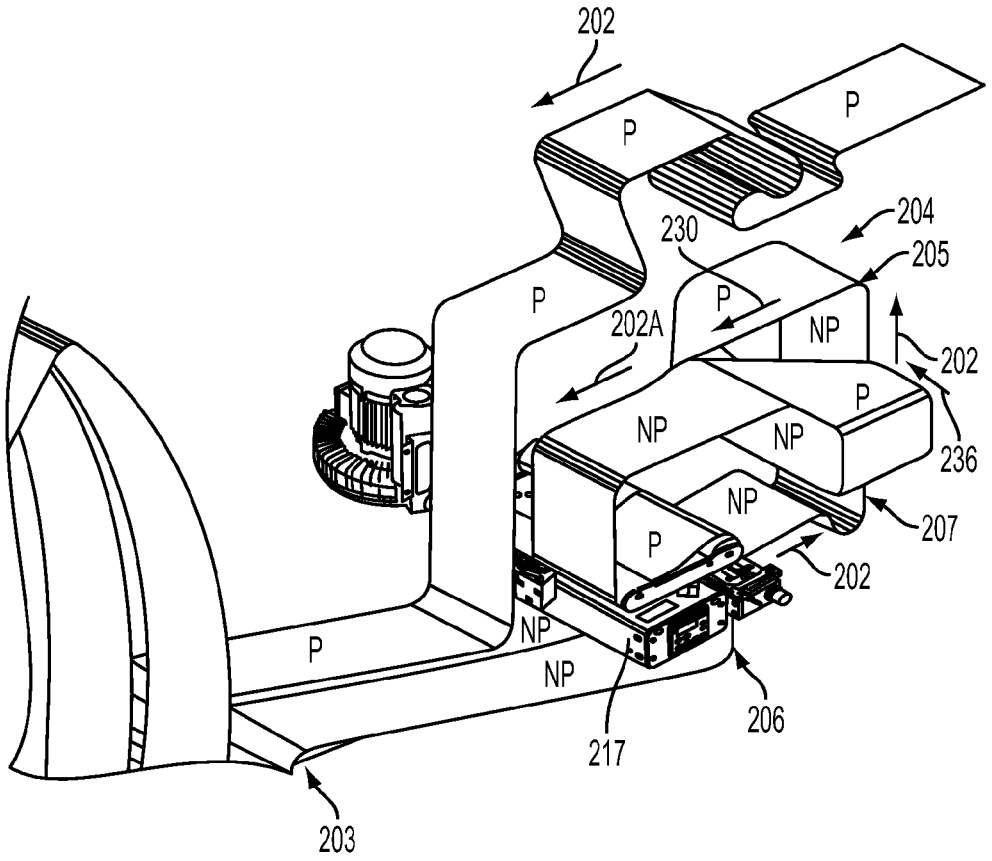
FIG. 2 is perspective view of a web path for a continuous web of print media moving through an inversion apparatus.

FIG. 1 is an elevational perspective view of one embodiment of an inversion apparatus 200 to invert the web to enable printing of the web on the unprinted side. FIG. 2 illustrates a flow path of the continuous web of recording media and is discussed in combination with FIG. 1, where a portion of the inversion apparatus is not shown to more clearly illustrate the paper path and transport direction. FIG. 2 also illustrates a transport direction 202 toward the print modules, away from the print modules, to the inversion apparatus 200, and back to the print modules for printing on the second side of the web. The letter P is used to illustrate the first side of the web being printed on during a first pass of the web through a printer. The letters NP are used to illustrate the second side of the web which is not printed on during a first pass of the web through a printer, but which is transported toward the print modules for printing on the NP side, or second side, at location 203. The inversion apparatus 200 of FIG. 1 replaces the web inverter 168 illustrated in FIG. 9. FIG. 9 illustrates a media path P and an inverter path P' wherein the web moves into one side (the left illustrated side) of the web inverter 168 and out another side (the right illustrated side) of the web inverter. In the inversion apparatus 200 of FIG. 1, the web reverses direction within the inversion apparatus 200. Consequently, the arrow 202A corresponds to the inverter path P' located on the right side of the web inverter 168 as illustrated in FIG. 9.

The inversion apparatus 200, or turnbar assembly, includes an input 204, an output 206, a turnbar mechanism 208 (not shown in FIG. 2), an idler roller device 210 (not shown in FIG. 2), a displacement guide assembly 211, and a blower 212. In this embodiment, the inversion apparatus 200 includes the input 204 generally shown as being located on the right side of the inversion apparatus 200 as illustrated in FIG. 1. At the input 204, an input roller 214 receives and supports the web media after one side of the media has been imaged by the print modules at a location 205 shown in FIG. 2. The roller 214 is supported by a frame not shown.

A first turnbar 220 is generally diagonally supported with respect to the paper path 202 by a first portion of a frame 222. A second turnbar 224 is also generally diagonally supported in a direction substantially perpendicular to the support location of roller 220 by the frame 222. Turnbar 224 directs the unprinted side of the web back to the printing system for completion of a duplex image. The first turnbar 220 is located beneath the second turnbar 222 as illustrated and receives the media web after passing up from the bottom of the machine at location 207 from the supply side first pass. Once the web enters the turnbar assembly 200, the web is transported in a direction 230 across the top surface of the turnbar 220 and wraps around the turnbar 220 where the web is directed toward a first idler roller 232. The web is then directed towards a second idler roller 234 and moves in a direction 236 towards the second turnbar 224. The web wraps around the second turnbar 224 and is directed toward the output 206 and through the displacement guide assembly 211 where the web is directed to the location 203 for printing on the second side of the web. The displacement guide assembly 211 adjusts the lateral position of the web for printing on the second side of the web. A lateral edge sensor (not shown) keeps the exit position of the web to within approximately plus or minus 0.1 millimeter (mm) for transport to the print modules 80-99.

As illustrated in FIG. 2, the non-printed side of the continuous web of recording media is located adjacent to the external surfaces of the turnbars. Such placement of the web substantially reduces or prevents image drag out and scratching of images which could occur should the imaged side of the web face the turnbar surfaces during inversion from one side of the web to the other.

The first idler roller 232 and the second idler roller 234 can include a surface formed of a composite material placed on a metal roller or it can be a metal anodized roller. The composite material can either have a smooth surface or can be a treaded surface. In addition, one or both of the first idler roller 232 and the second idler roller 234 can be adjustably mounted in the inversion apparatus 200 to provide for registration adjustment of a first side image to a second side image.

The blower 212 of FIG. 1 includes first and second blower outputs each respectively operatively connected to one of the turnbars 220 and 224. Each of the turnbars 220 and 224 include internal cavities which receive forced air from the blower 212. A plurality of apertures formed in the surface of a turnbar, as discussed below with reference to FIGS. 3-6, directs the forced air from the internal cavity to the surface of the turnbar where the forced air escapes. As the continuous web of print media moves across the turnbars, a cushion of air, or an air foil, is formed between the surface of the turnbar and the surface of the web facing the turnbar surface. Two blowers can be used in place of a single blower having two outputs.

The air directed through the apertures of the turnbar provides a lifting pressure to separate the web from the surface of the turnbar during movement of the web. The lifting force provided by the turnbar apertures depends on the air pressure provided by the blower, the area outer perimeter of the turnbar in contact with the paper, and the number and location of apertures formed in the surface of the turnbar through which the forced air escapes. The outer diameter of the turnbar determines the contact pressure of the paper to the surface given by tension/radius (T/R) psi. As the turnbar radius increases the T/R pressure will drop and the blower pressure can be reduced to provide the force to provide a stable gap. However; when increasing the diameter of the turnbar, which reduces the T/R pressure thereby providing more lift with a smaller blower pressure, more air flow is required due to a larger perimeter loss area. In one embodiment as illustrated in FIG. 1, the first turnbar 220 and the second turnbar 224 each include a diameter of approximately 3.5 inches.

In one embodiment of a known inversion apparatus, a turnbar assembly is used to flip the image between print engines or between stations on a flexo machine, a printing machine which utilizes a flexible relief plate, wherein the first side of the web being imaged first comes into contact with the turnbars when transported through an inversion apparatus. In most systems whether they flip on the image or non-image side the tensions are low <0.1 pli and the turnbar diameters are four inches in diameter. At these low tensions, the turnbar blower is relatively small in pressure and volume delivery. However, when the turnbar is inserted in a high tension control loop having a range of 2 to 5 pli, in one embodiment, the need for a larger turnbar diameter and higher blower flow rates is desirable. If the web drags on the surface of the turnbar, the tension loop is disturbed and excites the printing machine to a web drive resonance of twenty-two (22) hertz which causes misregistration of images. In a printer with 3.5 inch diameter turnbar, the T/R pressure is nominally 1 pound per square inch (psi) surface pressure. The most difficult region to float the web at high tensions is at the turnbar tangents The arrangement of holes around the entrance and exit web to turnbar tangents is critical. See FIGS. 3 and 5. The first row of lift holes are placed outside an incoming tangent line in a direction opposite the direction of travel of the web before the incoming tangent line and the row of exit holes are located after the outgoing tangent line. In one embodiment, the first row of holes is 10 degrees before the incoming tangent line and the row of exit holes is 10 degrees after the outgoing tangent line, so that the included angle between the rows of holes is 200 degrees included.

The placement of the holes includes at least three features: 1) the eddy currents generated by Bernoulli laws are reduced which eliminates the tendency to pull the web to the turnbar instead of lifting it away from the tangent entrance if the holes were located directly on center; 2) the second effect is to reduce the acoustic noise from the excitation of both web (drum skin) and air through the gap, for instance in one example with the holes placed directly on the tangent acoustic noise is greater than 95 decibels (db) and with the holes rotated 10 degrees past tangent the sound level is reduced 10 db; and 3) the optimized hole pattern assists the ensures that the web at high tension floats the web over the entire wrap of and without touching the turnbar using a given supply pressure and flow rate from a reasonably sized commercial blower. In one embodiment, a Bush 310D blower is used and which is available from Busch USA, Virginia Beach, Va. The operating points used in this embodiment for the blower are approximately 1 to 1.25 psi pressure at flows of 170 to 180 cfm.

In the present disclosure, printing at higher speeds is achieved by establishing a relationship between the T/R pressure, aperture size of a turnbar, patterns of the apertures disposed on the turnbar surface, flow rate and blower pressure to provide a uniform float height or air cushion along incoming contact points of the web with the turnbar, including nips and paper edges.

The third important aspect of the described embodiments is to provide higher web tensions to control the different web tensions provided in the spreader nip at 6000 lb. pressure. In one embodiment, the spreader nip provides a differential strain in the paper due to paper thickness/ink coverage/layer thickness/coefficient of friction between ink drum and rubber spreader roll. The selected blower with the optimized hole pattern also allows for web tensions of up to 5.5 pli which allows for higher overall web tensions in the machine. This keeps side 1 to side 2 tension with high area coverage images to maintain a 4 to 5 kg differential. It is essential for web tracking that the side 1 tension not drop below a minimum threshold. In addition, by transporting the paper through the inversion apparatus on the non-image side to ensure no image drag out, the image streaking resulting from an image facing a surface of the turnbar is eliminated. By selecting transport speed, turnbar diameter, aperture size, and aperture pattern, a commercially available blower of reasonable size supplies a sufficient amount of airflow to provide an acceptable air cushion at both turnbars with one blower.

Figure 3:
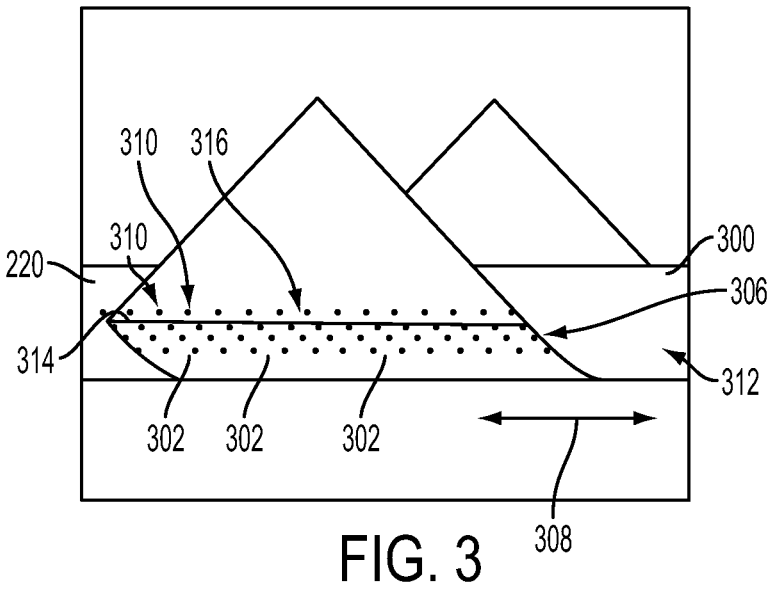
FIG. 3 is a top view of a turnbar having a plurality of apertures disposed on a surface thereof to provide an air cushion between a continuous web of print media having a first width and the surface of the turnbar.

FIG. 3 illustrates a top view of one of the turnbars, such as turnbar 220, with a 9.5 inch wide imaging web media, such as paper, wrapped 180 degrees about an exterior surface 300 of the turnbar. While the turnbar 220 is illustrated, in one embodiment the other turnbar 224 is similarly configured. The exterior surface 300 includes an air foil region having a plurality of apertures 302 which extend from an interior cavity of the turnbar 220, through a sidewall of the turnbar 220, and through the surface 300 to provide airflow from the interior to the exterior of the turnbar. The plurality of apertures 302 are arranged on the surface of the turnbar in a region of apertures 302 organized in a predetermined pattern 304. The predetermined pattern 304 includes a plurality of rows 306 extending along a longitudinal axis 308 of the turnbar 220. The predetermined pattern 304 is also organized to include a plurality of columns 310 disposed along a circumference of the turnbar 220, in which the columns 310 can be viewed as being either perpendicular to the longitudinal direction 308 or as being arranged diagonally as a helix about the circumference of the turnbar 220. A region of a non-apertured surface 312 is disposed outside the pattern 304.

The density of the apertures within the predetermined pattern 304, in part, determines the amount of an air foil or a float provided between the surface of the turnbar at the region 304 and the continuous web. If the continuous web of print media does not float above the surface of the turnbar 220, but instead contacts the surface 300, a tangent line is defined on the turnbar 220 along a leading edge and a trailing edge of the web. For instance, a tangent line 314 is defined on a leading edge of the turnbar 220 when no air cushion is provided. The trailing edge tangent line when no air cushion is provided is not shown. The predetermined pattern 304 is defined to include at least one row of apertures located before the tangent line 314 and at least one row of apertures located after the trailing edge tangent line. In the illustrated embodiments, a row of apertures is provided at the leading edge and trailing edge tangent lines. A row of apertures need not be provided at both the leading edge and trailing edge tangent lines. In other embodiments, one or both of the rows of apertures include a size different than the remaining apertures in the pattern 304. In still another embodiment, the number of apertures of the leading and trailing edge rows are different than the rows of apertures in the remaining pattern 304.

As the continuous web moves across the surface 300 of the turnbar 220, a row of apertures 316 outside the tangent lines 314 provides a float or air cushion in an area of the turnbar surface where the pressure under the web returns to atmosphere. The row 316 is spaced from the tangent line 314 by a distance of approximately the same distance existing between adjacent rows in the pattern 304 when the rows are evenly spaced. By placing at least one row of apertures before the leading edge tangent line and at least one row of apertures after the trailing edge tangent line, contact pressure between the web at the tangents is reduced or prevented. In one embodiment, the first and last row of holes are biased approximately ten (10) degrees before the incoming web tangent line and ten (10) degrees after the tangent line at the web exit. By locating the first and last row of apertures outside the tangent lines, eddy current cancelation is provided to aid in floating the web at the tangents. In another embodiment, the first and last rows of apertures are placed at the tangent lines, but include apertures of a different size that the remaining apertures of the pattern.

The first and last rows of apertures and the first and last columns of apertures define a perimeter where the first and last columns substantially coincide with the outer edges of the continuous web of recording media of the largest size of media being imaged. In the embodiment of FIG. 3, the width of the media is 9.5 inches. The first and last columns generally coincide with the outer edges of the width of the recording media. In one embodiment, the apertures within the perimeter defined by the pattern 304 are spaced evenly along the rows and along the columns such that no portion of the pattern within the perimeter is missing apertures.

Figure 4:
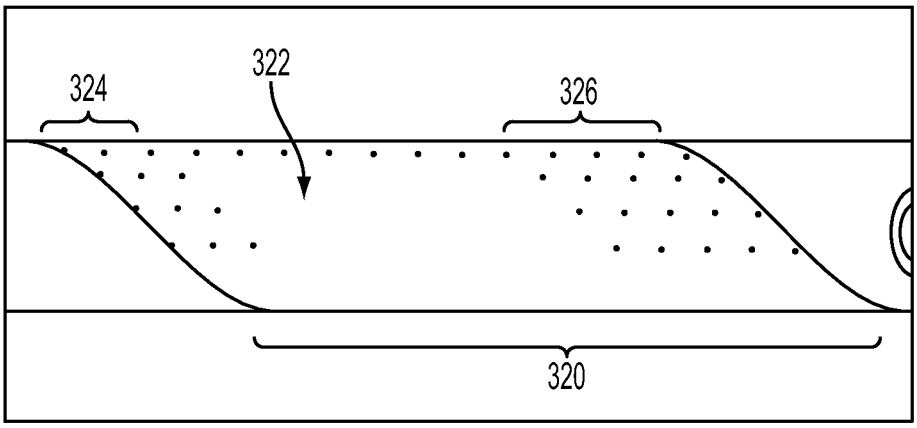
FIG. 4 is a front view of the turn bar of FIG. 3 having a plurality of apertures disposed on the surface thereof to provide an air cushion between a continuous web of print media having the first width where a portion of the surface is non-apertured.

FIG. 4 illustrates a front view another embodiment of a pattern of apertures 320 which in different embodiments are located on one or both of the turnbars 220 and or 224. The pattern of apertures 320 which defines the air foil region includes a non-apertured portion 322 located within a perimeter border of apertures including one or more rows of apertures and one or more columns of apertures. As described above, the perimeter of apertures includes first and last rows and first and last columns, where the first and last rows are located outside the tangent lines. In this embodiment, the non-apertured portion 322 is generally centrally located within the perimeter border of apertures. The perimeter of border apertures includes a plurality of columns of apertures 324 and a plurality of columns of apertures 326. At least one first and one last row of apertures is included in the pattern of apertures 320. The missing holes in the front view are not needed because the entrained air at the non-apertured surface between the apertures floats the web. The gap increases in this area. As can be seen in FIG. 4, three columns of apertures 324 are located on a left side of the portion 322 and four columns of apertures 326 are located on a right side of the portion 324. In this embodiment, the apertures which in one embodiment are located between the left side and right of the apertured surface at the non-apertured portion 322 are not required to assist in floating the web around the body of the turnbar 320. By reducing the number or apertures, the total amount of air flow generated by the blower 212 can be reduced.

Figure 5:
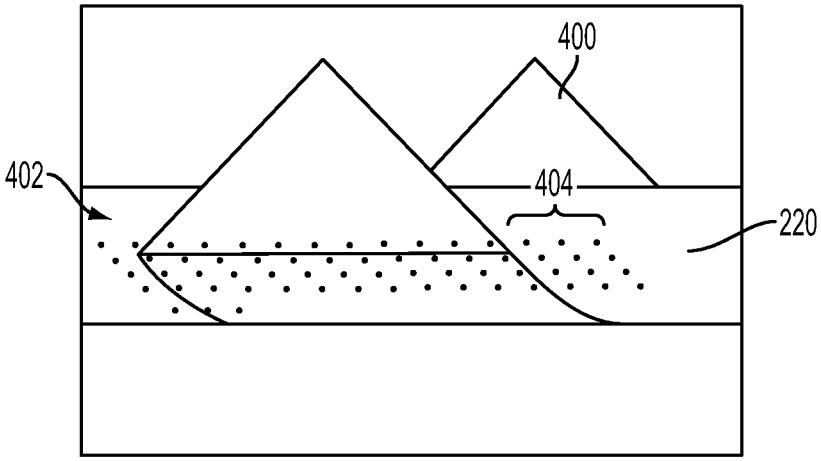
FIG. 5 is a top view of a turnbar having a plurality of apertures disposed on a surface thereof to provide an air cushion between a continuous web of print media, having a second width, and the surface of the turnbar.

FIG. 5 shows a seven inch wide continuous web 400 moving across the surface of the turnbar 220 of FIGS. 3 and/or 4 exposing four columns of apertures thus allowing more air to escape to atmosphere. One column of apertures 402 is exposed on the left side and three columns of apertures 404 is exposed on the right side. The floatation holes under the 7 inch web with air loss from the uncovered holes is sufficient pressure to counteract a T/R pressure of 1 psi to 1.25 psi. Also, the flotation holes must be small enough to maintain the internal plenum pressure with a chosen blower size.

Figure 6:
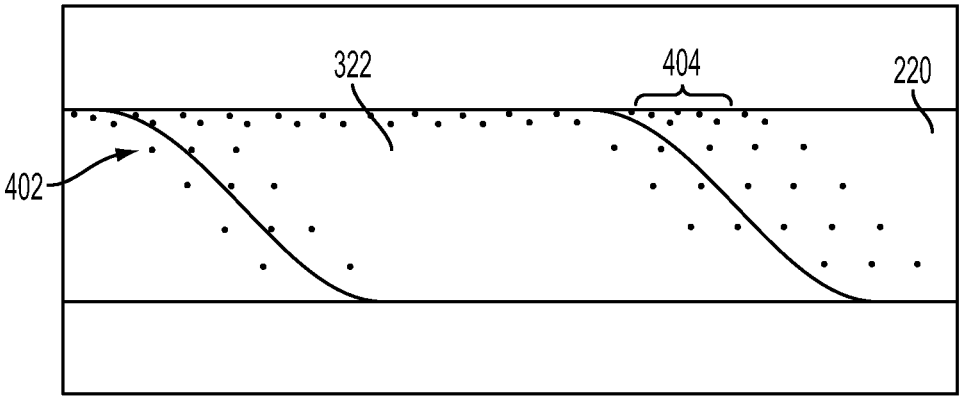
FIG. 6 is a front view of the turn bar of FIG. 5 having a plurality of apertures disposed on a surface thereof to provide an air cushion between a continuous web of print media having the second width where a portion of the surface is non-apertured.

FIG. 6 is the front view of the seven inch wide continuous web 400 on the turnbar 220 of FIG. 5. As can be seen, the non-apertured portion 322 is generally located within the edges of the perimeter of the apertured portion of the turnbar.

As described above, the Busch Model 0310D is used in one embodiment. While this particular blower has been chosen as being appropriately sized for this particular application, other types and sizes of blower are selected to provide the air flow for different embodiments. Since the described printer moves the continuous web of material at high speeds which require increased tensions of the transported web, the higher tensions provide high T/R pressures in one embodiment of about 0.7 psi that makes the generation of an air flow gap difficult to achieve. Therefore, the aperture size, the aperture distribution and the aperture quantity are determined to coordinate the amount of lift with the rate of air flow. In addition, the first and last row of apertures when moved away from and outside the contact area defined by the tangent contact points provides Bernoulli and eddy current cancelation at the leading edge and trailing edge where the pressure transitions to atmosphere. The leading and trailing rows outside the potential contact area defined by the tangents increases the float at the tangential contact points to reduce or prevent drag.

Figure 7:
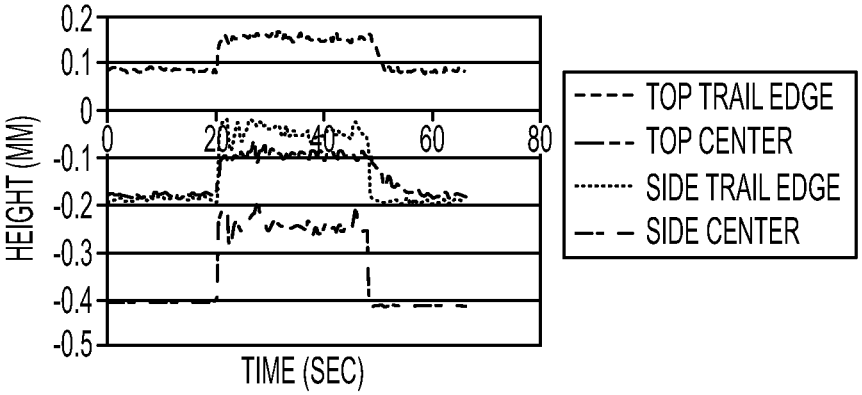
FIG. 7 is a graphical representation of a gap clearance between a surface of a turnbar and the continuous web of print media.

FIG. 7 is a graphical representation of a gap clearance between a surface of a turnbar and the continuous web of print media. In FIG. 7, a gap float height with the Busch 0310 blower for the 7 inch embodiment is shown in the case where three columns of holes are left exposed on a left side and a right side of the web. The exposure of three columns of apertures deflates the web in the wrap when the pressure drops below 1.1 psi. Since the printers are located in all elevations and climates, the blower size is increased where necessary to provide a desired float. For instance, in a location providing power at fifty (50) hertz and at an elevation of six-thousand (6000) feet, the size of the blower is increased to a blower of the 0310 size, available from Busch, to ensure that the web when printing to seven inch wide media with 4 or 5 columns of apertures exposed is elevated from the surface of the turnbar.

Figure 8:
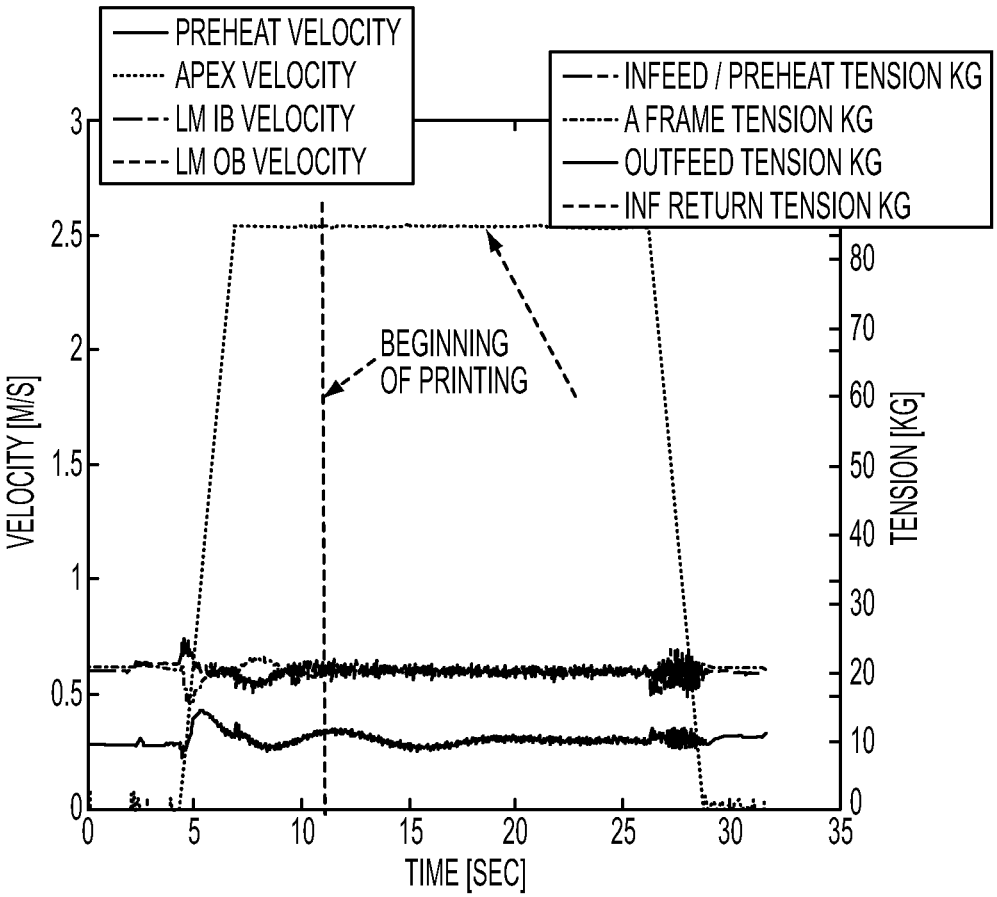
FIG. 8 is a graphical representation of velocity and tension versus time.

FIG. 8 is a graphical representation of velocity and tension versus time. In FIG. 8 the velocity and tension graphs demonstrating that the web does not drag and excite the twenty-two hertz transfer function resonance frequency of the web/drive system. The lower traces on the graph are the tension zones and are shown to be stable during the ramp up of the web.

The disclosed embodiments substantially prevent the web from touching the turnbars at increased rates of transport speeds.

In one embodiment, the turnbar includes a non-uniform hole pattern for highly tensioned webs on a small radius to provide sufficient lift gap with an appropriately sized blower. One blower handles two turn bars. The first and last rows of holes are leading and lagging the tangents to reduce the acoustic noise approximately 15 db lower than a printer having a known web drum skin resonance. Flotation of the web at the tangents reduces or eliminates web drag and turnbar wear.

It will be appreciated that variants of the above-disclosed and other features and functions, or alternatives thereof, can be desirably combined into many other different systems, applications or methods. Various presently unforeseen or unanticipated alternatives, modifications, variations or improvements can be subsequently made by those skilled in the art that are also intended to be encompassed by the following claims.

What is claimed is:

1. An inversion apparatus configured to invert a continuous web of recording media moving along a path in an imaging system, the inversion apparatus comprising:

an input configured to receive the continuous web of recording media;

an output, displaced from the input, the output configured to convey the continuous web of recording media after being inverted;

a blower configured to provide a flow of forced air;

a turnbar configured to convey the continuous web of recording media between the input and the output and to enable inversion of the continuous web of recording media, the turnbar defines a first tangent line corresponding to an initial point of contact of the web and the turnbar in the absence of an air gap, a second tangent line corresponding to a last point of contact of the web with the turnbar in the absence of an air gap, and a contacting area disposed between the first tangent line and the second tangent line in the absence of an air gap, the turnbar having an exterior surface defining a first region and a second region, which is substantially devoid of apertures, the first region having a plurality of apertures operatively connected to the blower, the plurality of apertures defining a pattern including a plurality of rows and a plurality of columns, each of the rows being aligned in a longitudinal direction along a length of the turnbar, one of a first row of apertures and a last row of apertures being disposed outside of the contacting area and being rotated approximately ten degrees beyond one of the first tangent line and the second tangent line, the plurality of apertures being configured to direct the forced air from the exterior surface of the turnbar, and the forced air through the second region is not directed from the exterior surface.

2. The inversion apparatus of claim 1 wherein the first region includes a portion in which forced air is not directed from the exterior surface.

3. The inversion apparatus of claim 2 wherein the portion in which forced air is not directed from the exterior surface is devoid of apertures.

4. The inversion apparatus of claim 1 wherein each of the columns includes a first aperture and a last aperture and the first aperture of each column is aligned along a first circumferential line and the last aperture of each column is aligned along a second circumferential line different than the first circumferential line.

5. The inversion apparatus of claim 4 wherein each of the columns defines a helix.

6. The inversion apparatus of claim 4 wherein the plurality of columns includes a first column and a last column and at least one of the plurality of columns is disposed outside of the contacting area.

7. A method of forming a duplex image on a continuous web of recording media having a first side and a second side, the continuous web moving along a transport path through a printer and a web inverter including a turnbar having a surface defining a plurality of apertures, and a blower operatively connected to the plurality of apertures to provide forced air to the apertures, the method comprising:

imaging the first side of the continuous web of recording media during a first pass through the printer;

directing the second side of the continuous web toward the plurality of apertures;

directing air through the plurality of apertures to provide an air gap between the second side of the continuous web of recording media and the surface of the turnbar, the surface of the turnbar defining a first tangent line corresponding to an initial point of contact of the continuous web with the turnbar in the absence of the air gap and a second tangent line corresponding to a last point of contact of the continuous web with the turnbar in the absence of the air gap, the directed air being confined to a predetermined region of the surface of the turnbar, the predetermined region extending over a first portion of the surface of the turnbar but not over a second portion of the surface of the turnbar, the predetermined region including a first edge and a second edge aligned along a longitudinal axis of the turnbar, the first edge and the second edge being separated by the second portion of the surface of the turnbar and one of the first edge and the second edge respectively extends past one of the first tangent line and the second tangent line such that the distance between the first edge and the second edge is greater than the distance between the first tangent line and the second tangent line taken along the transport path; and imaging the second side of the continuous web of recording media during a second pass through the printer.

8. The method of claim 7 wherein one of the first edge and the second edge are rotated approximately ten degrees beyond one of the first tangent line and the second tangent line to reduce at least one of eddy currents, acoustic noise, and higher tension without the web touching the turnbars.

9. An inversion apparatus configured to invert a continuous web of recording media moving along a path in an imaging system, the inversion apparatus comprising:

an input configured to receive the continuous web of recording media;

an output, displaced from the input, the output configured to convey the continuous web of recording media after being inverted; and a turnbar configured to convey the continuous web of recording media between the input and the output and to enable inversion of the continuous web of recording media, the turnbar includes an exterior surface having an air foil region with a plurality of apertures configured to provide an air gap between the exterior surface of the turnbar and the recording media and a second region substantially devoid of apertures, the exterior surface of the turnbar defines a first tangent line corresponding to an initial point of contact of the continuous web with the turnbar in the absence of the air gap and a second tangent line corresponding to a last point of contact of the continuous web with the turnbar in the absence of the air gap, the air foil region includes a first edge and a second edge aligned along the longitudinal axis of the turnbar and the first edge and the second edge are separated by the second region, one of the first edge and the second edge respectively extends past one of the first tangent line and the second tangent line such that a distance between the first edge and the second edge is greater than a distance between the first tangent line and the second tangent line taken along the transport path.

10. The inversion apparatus of claim 9 wherein one of the first edge and the second edge are rotated approximately ten degrees beyond one of the first tangent line and the second tangent line.

11. The inversion apparatus of claim 10, the air foil region further comprising:

a portion devoid of apertures.

12. The inversion apparatus of claim 11, the plurality of apertures in the air foil region being arranged in a plurality of columns configured as a cylindrical helix.

13. The inversion apparatus of claim 12, the plurality of apertures arranged in the plurality of columns having a first column and a last column disposed outside the edges of the recording media in the absence of the air gap when the recording media Is in contact with the turnbar.

* * * * *